US009483989B2

(12) United States Patent
Kim et al.

(10) Patent No.: US 9,483,989 B2
(45) Date of Patent: Nov. 1, 2016

(54) METHOD OF ADJUSTING SOURCE VOLTAGE BY VERTICAL PORTION FOR DRIVING DISPLAY PANEL AND DISPLAY APPARATUS PERFORMING THE METHOD

(71) Applicant: Samsung Display Co., Ltd., Yongin, Gyeonggi-Do (KR)

(72) Inventors: Jung-Taek Kim, Seoul (KR); Young-Soo Yoon, Seoul (KR); Eun-Ho Lee, Suwon-si (KR); Ji-Woong Jeong, Yongin-si (KR); Seok-Ha Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 131 days.

(21) Appl. No.: 14/067,708

(22) Filed: Oct. 30, 2013

(65) Prior Publication Data

US 2015/0009241 A1 Jan. 8, 2015

(30) Foreign Application Priority Data

Jul. 5, 2013 (KR) ..... 10-2013-0078860

(51) Int. Cl.
*G09G 3/36* (2006.01)
*G09G 3/34* (2006.01)
*G09G 3/30* (2006.01)

(52) U.S. Cl.
CPC .... *G09G 3/3648* (2013.01); *G09G 2320/0285* (2013.01); *G09G 2320/0673* (2013.01); *G09G 2330/021* (2013.01); *G09G 2360/16* (2013.01)

(58) Field of Classification Search
CPC ... G09G 3/2003–3/2081; G09G 3/36–3/3696; G09G 3/3644; G09G 2300/0866; G09G 2310/0248–2310/0251; G09G 2310/0271–2310/0276; G09G 2310/0289; G09G 2310/0673
USPC ..... 345/87–104, 211–213
See application file for complete search history.

(56) References Cited

U.S. PATENT DOCUMENTS

| | | | | |
|---|---|---|---|---|
| 6,249,270 | B1 * | 6/2001 | Ito | G09G 3/3688 345/100 |
| 2008/0012840 | A1 * | 1/2008 | Higashino | G09G 3/3688 345/204 |
| 2009/0243983 | A1 * | 10/2009 | Ohashi | G09G 3/2011 345/89 |
| 2010/0053145 | A1 * | 3/2010 | Morita | G09G 3/3688 345/213 |
| 2010/0103202 | A1 * | 4/2010 | Seo | G09G 3/3426 345/690 |
| 2013/0241914 | A1 * | 9/2013 | Kitagawa | G09G 3/3648 345/212 |

* cited by examiner

*Primary Examiner* — Sanghyuk Park
(74) *Attorney, Agent, or Firm* — Lewis Roca Rothgerber Christie LLP

(57) ABSTRACT

A method of driving a display panel includes determining a source voltage level by a vertical portion in a present horizontal line of the display panel based on data of the present horizontal line, the display panel including a plurality of vertical portions extended along a vertical direction and arranged in a horizontal direction (the plurality of vertical portions including a vertical portion), generating correction data of the present horizontal line by the vertical portion utilizing the source voltage level of the present horizontal line determined by the vertical portion, generating a source voltage of the present horizontal line by the vertical portion utilizing the source voltage level of the horizontal line determined by the vertical portion, and driving the display panel by the vertical portion utilizing the correction data and the source voltage of the present horizontal line.

18 Claims, 5 Drawing Sheets

FIG. 4

| LINE NUMBER | MAX_D | MAX_V | MIN(n+1) | MIN(n+2) | MIN(n-1) | AP_V |
|---|---|---|---|---|---|---|
| LINE1 | 207 | 5.78 | 2.53 | -2.10 | 1.78 | 5.78 |
| LINE2 | 240 | 6.53 | 1.89 | -2.02 | 1.78 | 6.53 |
| LINE3 | 215 | 5.89 | 1.98 | -2.05 | 2.53 | 5.89 |
| LINE4 | 220 | 5.98 | 1.94 | -2.06 | 1.89 | 5.98 |
| LINE5 | 218 | 5.94 | 1.93 | -2.05 | 1.98 | 5.94 |
| LINE6 | 217 | 5.93 | 1.94 | -2.19 | 1.94 | 5.93 |
| LINE7 | 218 | 5.94 | 1.80 | -2.14 | 1.93 | 5.94 |
| LINE8 | 208 | 5.80 | 1.85 | -2.27 | 1.94 | 5.80 |
| LINE9 | 212 | 5.85 | 1.72 | -2.39 | 1.80 | 5.85 |
| | 202 | 5.72 | 1.60 | | 1.85 | 5.72 |

METHOD OF ADJUSTING SOURCE VOLTAGE BY VERTICAL PORTION FOR DRIVING DISPLAY PANEL AND DISPLAY APPARATUS PERFORMING THE METHOD

CROSS-REFERENCE TO RELATED APPLICATION

This application claims priority to and the benefit of Korean Patent Application No. 10-2013-0078860 filed on Jul. 5, 2013, which is hereby incorporated by reference in its entirety and for all purposes as if fully set forth herein.

BACKGROUND

1. Field

Exemplary (example) embodiments of the present invention relate to a method of driving a display panel and a display apparatus performing the method. More particularly, exemplary embodiments of the present invention relate to a method of driving a display panel capable of decreasing power consumption and a display apparatus performing the method.

2. Description of the Related Art

Generally, a liquid crystal display (LCD) apparatus is relatively thin in thickness, is light weight and has low power consumption, and thus the LCD apparatus is used in monitors, laptop computers and cellular phones, etc. The LCD apparatus includes an LCD panel displaying images utilizing a light transmittance of a liquid crystal, a backlight assembly disposed under the LCD panel and providing light to the LCD panel and a driving circuit driving the LCD panel.

The LCD panel includes: an array substrate which has a gate line, a data line, a thin film transistor and a pixel electrode; an opposing substrate which has a common electrode; and a liquid crystal layer between the array substrate and the opposing substrate. The driving circuit includes a gate driving part which drives the gate line and the data driving part which drives the data line. The data driving part converts digital data into a data voltage utilizing a maximum source voltage (AVDD).

Generally, the maximum source voltage (AVDD) is applied to the data driving part independent (irrelevant) to grayscales of an image displayed on the LCD panel. Thus, when the image of a low grayscale is displayed on the LCD panel, the data driving part may convert the digital data of the low grayscale into the data voltage utilizing a low source voltage less than the maximum source voltage (AVDD). However, the data driving part converts the digital data of the low grayscale into the data voltage utilizing the maximum source voltage (VDD) that is more than the low source voltage corresponding to the image of the low grayscale, and this may result in an unnecessary increase in power consumption.

SUMMARY

Aspects of exemplary embodiments of the present invention provide a method of driving a display panel capable of reducing power consumption.

Aspects of exemplary embodiments of the present invention also provide a display apparatus performing the method of driving the display panel.

According to an exemplary embodiment of the invention, there is provided a method of driving a display panel, the method including determining a source voltage level by a vertical portion in a present horizontal line of the display panel based on data of the present horizontal line, the display panel including a plurality of vertical portions extended along a vertical direction and arranged in a horizontal direction (the plurality of vertical portions including a vertical portion), generating correction data of the present horizontal line by the vertical portion utilizing the source voltage level of the present horizontal line determined by the vertical portion, generating a source voltage of the present horizontal line by the vertical portion utilizing the source voltage level of the horizontal line determined by the vertical portion, and driving the display panel by the vertical portion utilizing the correction data and the source voltage of the present horizontal line.

In an exemplary embodiment, the determining the source voltage level may include calculating a variable voltage level with which a voltage can change during a horizontal blanking period, calculating a number of the horizontal line corresponding to a period during which a reference voltage is to derive a maximum source voltage based on the variable voltage level, converting maximum data of the present horizontal line and a next horizontal line which is located after the present horizontal line to maximum voltage levels, respectively, calculating a next minimum voltage level of the present horizontal line, the next minimum voltage level which is to derive a voltage level of the present horizontal line in at a necessary voltage level of the next horizontal line, calculating a previous minimum voltage level of the present horizontal line, the previous minimum voltage level which is to derive a necessary voltage level of a previous horizontal line at the voltage level of the present horizontal line, the previous horizontal line which is located before the present horizontal line, and determining the source voltage level of the present horizontal line utilizing the maximum voltage level, the next minimum voltage level and the previous minimum voltage level of the present horizontal line.

In an exemplary embodiment, the source voltage level of the present horizontal line may be determined as a maximum value among the maximum voltage level, the next minimum voltage level and the previous minimum voltage level.

In an exemplary embodiment, the method may further include storing data of the horizontal line corresponding to the number of the horizontal line calculated based on the variable voltage level.

In an exemplary embodiment, the next minimum voltage level may be calculated by utilizing the maximum voltage level of the next horizontal line and the variable voltage level.

In an exemplary embodiment, the previous minimum voltage level may be calculated by utilizing the source voltage level of the previous horizontal line and the variable voltage level.

In an exemplary embodiment, the correction data of the present horizontal line may be generated by utilizing a gray-voltage look-up table (LUT).

In an exemplary embodiment, the correction data and the source voltage of the present horizontal line may be generated during the vertical blanking period.

According to another exemplary embodiment of the invention, there is provided a display apparatus including a display panel which includes a display element electrically connected to a data line and a gate line and is divided into a plurality of vertical portions including a vertical portion, the vertical portions extended along a longitudinal direction of the data line and arranged in a longitudinal direction of the gate line, a data processing part which determines a source voltage level by the vertical portion in a present horizontal line of the display panel based on maximum data of the present horizontal line and generates correction data of the present horizontal line by the vertical portion utilizing the source voltage level of the present horizontal line, a source voltage generating part which generates a source voltage of the present horizontal line by the vertical portion utilizing the source voltage level of the horizontal line determined by the vertical portion, and a data driving part which drives the display panel by the vertical portion utilizing the correction data and the source voltage of the present horizontal line.

In an exemplary embodiment, the data processing part may include a calculating part which calculates a variable voltage level with which a voltage can change during a horizontal blanking period and a number of the horizontal line corresponding to a period during which a reference voltage is to derive a maximum source voltage based on the variable voltage level, a detecting/converting part which converts maximum data of the present horizontal line and a next horizontal line which is located after the present horizontal line to maximum voltage levels, respectively, a source voltage determining part which calculates a next minimum voltage level of the present horizontal line, the next minimum voltage level which is to derive a voltage level of the present horizontal line in at a necessary voltage level of the next horizontal line, calculates a previous minimum voltage level of the present horizontal line, the previous minimum voltage level which is to derive a necessary voltage level of a previous horizontal line at the voltage level of the present horizontal line, the previous horizontal line which is located before the present horizontal line and determines the source voltage level of the present horizontal line utilizing the maximum voltage level, the next minimum voltage level and the previous minimum voltage level of the present horizontal line, and a data correcting part which generates the correction data of the present horizontal line by the vertical portion utilizing the source voltage level of the present horizontal line.

In an exemplary embodiment, the source voltage determining part may determine the source voltage level of the present horizontal line as a maximum level of the maximum voltage level, the next minimum voltage level and the previous minimum voltage level.

In an exemplary embodiment, the data processing part may further include a storing part which stores data of the horizontal line corresponding to the number of the horizontal line calculated based on the variable voltage level.

In an exemplary embodiment, the next minimum voltage level may be calculated by utilizing the maximum voltage level of the next horizontal line and the variable voltage level.

In an exemplary embodiment, the previous minimum voltage level may be calculated by utilizing the source voltage level of the previous horizontal line and the variable voltage level.

In an exemplary embodiment, the correction data of the present horizontal line may be generated by utilizing a gray-voltage look-up table (LUT).

In an exemplary embodiment, the correction data and the source voltage of the present horizontal line may be generated during the horizontal blanking period.

In an exemplary embodiment, the data driving part may include first to k-th data driving circuits, and the plurality of vertical portion of the display panel may be divided into first to k-th vertical portions corresponding to the first to k-th data driving circuits.

In an exemplary embodiment, the display element may be a liquid crystal capacitor including a liquid crystal layer.

In an exemplary embodiment, the display element may be an organic light emitting display OILED element including an organic light emitting layer.

In an exemplary embodiment, the display element may be an electrophoretic display EPD element including an electrophoretic layer.

According to exemplary embodiments of the present invention, the source voltage level applied to the data driving part may be adjusted by the vertical portion and the horizontal line based on the image displayed on the display panel. Thus, the display panel may be driven utilizing a minimum necessary voltage so that the power consumption may be reduced. In addition, the source voltage level of the present horizontal line may be determined based on the source voltage levels of at least one of the next horizontal line and the previous horizontal line so that a display quality may be improved.

BRIEF DESCRIPTION OF THE DRAWINGS

The above and other features and advantages of the present invention will become more apparent by describing in detailed exemplary embodiments thereof with reference to the accompanying drawings, in which:

FIG. 4 is a conceptual diagram illustrating a method of determining a level of a source voltage as shown in FIG. 3.

DETAILED DESCRIPTION

Hereinafter, exemplary embodiment of the present invention will be explained in detail with reference to the accompanying drawings. Expressions such as "at least one of," when preceding a list of elements, modify the entire list of elements and do not modify the individual elements of the list. Further, the use of "may" when describing embodiments of the present invention refers to "one or more embodiments of the present invention."

Figure 1:
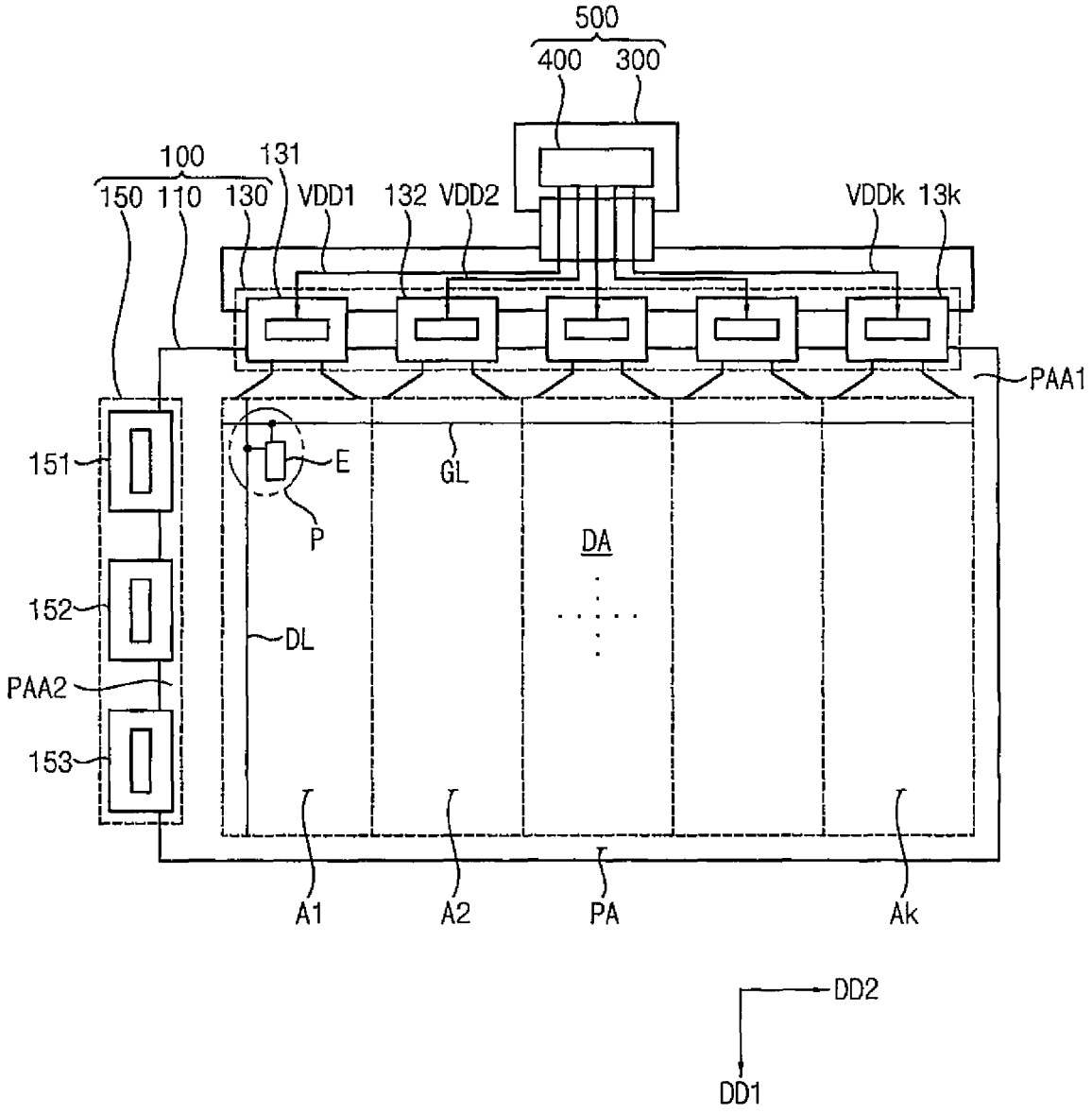
FIG. 1 is a plan view illustrating a display apparatus according to an exemplary embodiment.

FIG. 1 is a plan view illustrating a display apparatus according to an exemplary embodiment.

Referring to FIG. 1, the display apparatus may include a panel assembly 100 and a circuit assembly 500.

The panel assembly 100 may include a display panel 110, a data driving part 130 and a gate driving part 150.

The display panel 110 may include a display area DA and a peripheral area PA surrounding the display area DA. The display area DA may include a plurality of data lines DL, a plurality of gate lines GL and a plurality of pixels P. The data lines DL are extended along a first direction DD1 and arranged in (i.e., arranged to be separated from each other in) a second direction DD2 crossing the first direction DD1. The gate lines GL are extended along the second direction DD2 and arranged in (i.e., arranged to be separated from each other in) the first direction DD1. The pixels P are arranged as a matrix type which includes a plurality of pixel columns and a plurality of pixel rows. Each of the pixel columns includes a plurality of pixels which is arranged in the first direction DD1 and each of the pixel rows includes a plurality of pixels which is arranged in the second direction DD2. The pixel row will be referred to as a horizontal line. Each pixel P includes a display element E which is electrically connected to a data line DL and a gate line GL. The display element E may include a liquid crystal capacitor including a liquid crystal layer, an organic light emitting display (OLED) element including an organic light emitting layer or an electrophoretic display (EPD) element including an electrophoretic layer.

The data driving part 130 and the gate driving part 150 are disposed at the peripheral area PA. The data driving part 130 is disposed at a first peripheral area PAA1 corresponding to end portions of the data lines DL and the gate driving part 150 is disposed at a second peripheral area PAA2 corresponding to end portions of the gate lines GL.

The data driving part 130 may include a plurality of data driving circuits 131, 132, . . . , 13*k* (herein, k is a natural number). Each data driving circuit outputs a data voltage to the data line DL. According to the exemplary embodiment, the display area DA may be divided into a plurality of vertical portions A1, A2, . . . , Ak and the vertical portions A1, A2, . . . , Ak may be driven by the data driving circuits 131, 132, . . . , 13*k*. As shown in FIG. 1, k data driving circuits 131, 132, . . . , 13*k* may respectively drive k vertical portions A1, A2, . . . , Ak. Alternatively, the display area DA is divided into k/m vertical portions and the k/m vertical portions may be driven by the k data driving circuits 131, 132, . . . , 13*k* (herein, M is a natural number).

The gate driving part 150 may include a plurality of gate driving circuits 151, 152 and 153. Each of the gate driving circuits 151, 152 and 153 sequentially outputs a gate signal to the gate line GL.

The circuit assembly 500 may include a printed circuit board 300 and a driving circuit part 400 disposed on the printed circuit board 300.

The driving circuit part 400 may output a data control signal controlling an operation of the data driving part 130 and a gate control signal controlling an operation of the gate driving part 150. The data control signal may include a vertical synchronization signal. A horizontal synchronization signal, a data clock signal, a data enable signal, a load signal, etc. The gate control signal may include a start vertical signal (STV), a gate clock signal, a gate enable signal, etc.

According to the exemplary embodiment, the driving circuit part 400 generates source voltages VDD1, VDD2, . . . , VDDk corresponding to the vertical portions A1, A2, . . . , Ak in the horizontal line (pixel row) of the display panel 110 based on data of the horizontal line data (pixel row data), generates correction data of the horizontal line based on the source voltages VDD1, VDD2, . . . , VDDk and provides the data driving circuits 131, 132, . . . , 13*k* respectively corresponding to the vertical portions A1, A2, . . . , Ak with the correction data of the horizontal line. The driving circuit part 400 may generate the source voltages VDD1, VDD2, . . . , VDDk and the correction data during a blanking period of a horizontal period, and may provide the data driving circuits 131, 132, . . . , 13*k* with the source voltages VDD1, VDD2, . . . , VDDk and the correction data during an active period of the horizontal period.

According to the exemplary embodiment, the source voltage of the driving circuit part 400 may be adjusted based on a grayscale of an image displayed on the vertical portion in the horizontal line so that the display panel 110 may be driven by utilizing a minimum necessary voltage. Therefore, the power consumption may be reduced.

Figure 2:
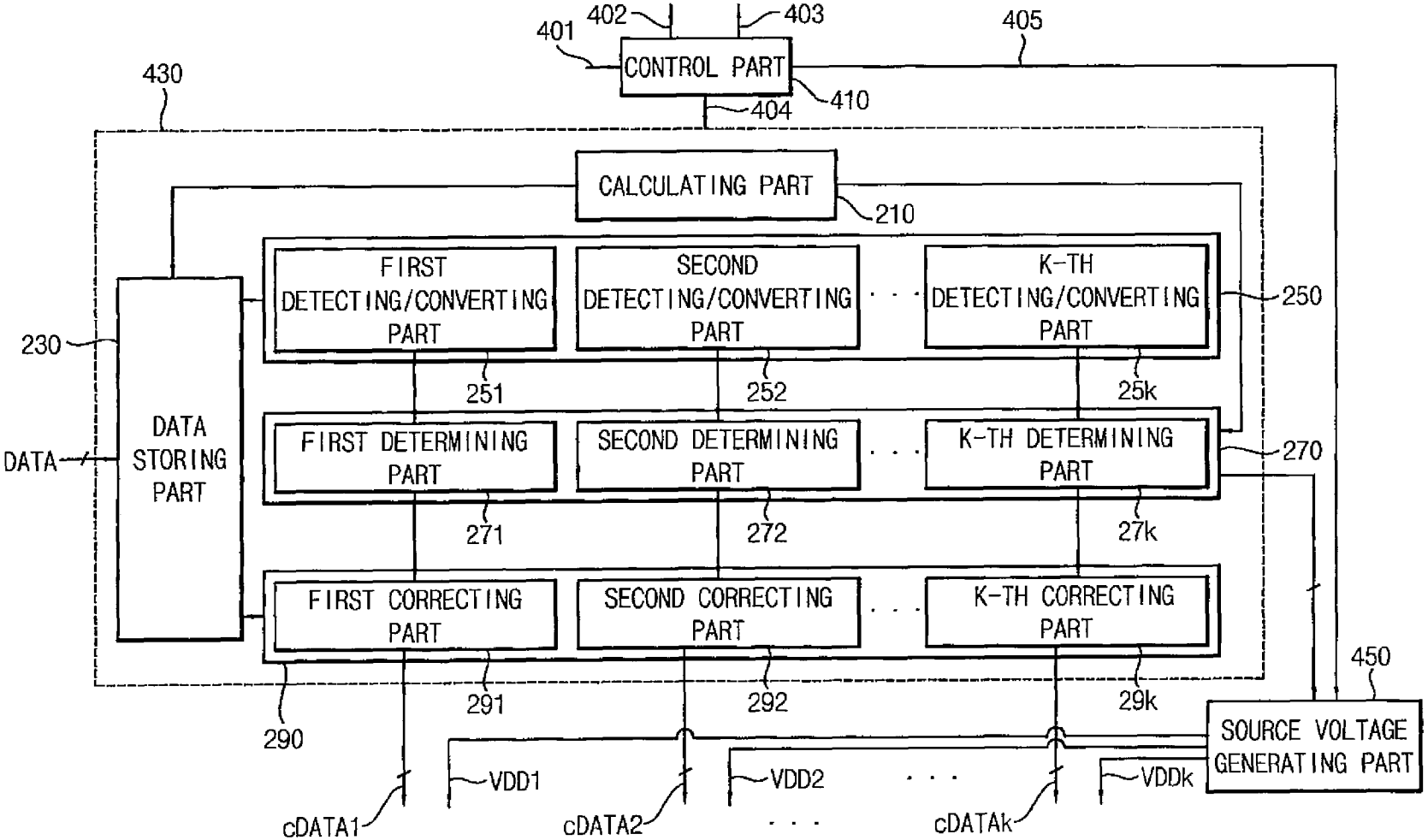
FIG. 2 is a block diagram illustrating a driving circuit part as shown in FIG. 1.

FIG. 2 is a block diagram illustrating a driving circuit part as shown in FIG. 1.

Referring to FIGS. 1 and 2, the driving circuit part 400 may include a control part 410, a data processing part 430 and a source voltage generating part 450.

The control part 410 generates the data control signal 402 and the gate control signal 403 based on an original control signal 401. According to the exemplary embodiment, the control part 410 generates (1) a control signal 404 for controlling the data processing part 430 and (2) a control signal 405 for controlling the source voltage generating part 450.

The data processing part 430 may include a calculating part 210, a data storing part 230, a data detecting/converting part 250, a source voltage determining part 270 and a data correcting part 290.

The calculating part 210 calculates a variable voltage level based on a change rate (slew rate) and a propagation delay time of the voltage outputted from the source voltage generating part 450. The voltage can change with the variable voltage level during a horizontal blanking period. The calculating part 210 calculates a number of the horizontal line corresponding to a period during which a reference voltage Vcom is to derive a maximum source voltage VDDmax based on the variable voltage level. For example, when the variable voltage level is 5 V, the reference voltage Vcom is 0 V and the maximum source voltage VDDmax is 10 V, the number of horizontal line is calculated as "2".

The data storing part 230 stores data DATA of a horizontal line. According to the exemplary embodiment, the data storing part 230 may store data of at least one horizontal line corresponding to the number of the horizontal line calculated from the calculating part 210.

The data detecting/converting part 250 detects maximum data of the data in the vertical portion utilizing the data stored at the data storing part 230. The data detecting/converting part 250 converts the maximum data to a maximum voltage level. According to the exemplary embodiment, the data detecting/converting part 250 may include first to k-th detecting/converting parts 251, 252, . . . , 25*k* respectively corresponding to the first to k-th vertical portions A1, A2, . . . , Ak of the display panel 110.

For example, a first detecting/converting part 251 detects first maximum data in the first vertical portion A1 of an n-th horizontal line and converts the first maximum data to a first maximum voltage level (herein, n is natural number). A second detecting/converting part 252 detects second maximum data in the second vertical portion A2 of the n-th horizontal line and converts the second maximum data to a second maximum voltage level. As described above, a k-th detecting/converting part 25*k* detects k-th maximum data in the k-th vertical portion Ak of the n-th horizontal line and converts the k-th maximum data to a k-th maximum voltage level.

The source voltage determining part 270 calculates next minimum voltage level and previous minimum voltage level of the present horizontal line (e.g., the n-th horizontal line or n-th pixel row) based on the variable voltage level. The next minimum voltage level is a minimum voltage level which is to derive a voltage level of the present horizontal line at a necessary voltage level of a next horizontal line. The next minimum voltage level may be a level difference between a necessary voltage level of the next horizontal line and the variable voltage level corresponding to a line space between the present horizontal line and the next horizontal line. The next horizontal line is located after the present horizontal line. The necessary voltage of the next horizontal line may be the maximum voltage level of the next horizontal line. The previous minimum voltage level is a minimum voltage level which is to derive a necessary voltage level of a previous horizontal line at the voltage level of the present horizontal line. The previous minimum voltage level may be a level difference between the necessary voltage of the previous horizontal line and the variable voltage. The next horizontal line is located after the present horizontal line. The necessary voltage of the next horizontal line may be the maximum voltage level of the next horizontal line. The previous horizontal line is located before the present horizontal line. The necessary voltage of the previous horizontal line may be the source voltage level of the previous horizontal line. The source voltage determining part 270 determines the source voltage level of the present horizontal line as a maximum value among the maximum voltage level, next minimum voltage level and previous minimum voltage level of the present horizontal line. According to the exemplary embodiment, the source voltage determining part 270 may include first to k-th determining parts 271, 272, . . . , 27*k* corresponding to the first to k-th vertical portions A1, A2, . . . , Ak.

For example, the present horizontal line is an n-th horizontal line and the number of the horizontal line based on the variable voltage level is "3", the next horizontal line includes (n+1)-th and (n+2)-th horizontal lines and the previous horizontal line is an (n−1)-th horizontal line.

In this case, a first determining part 271 calculates first minimum voltage levels of the n-th horizontal line in the first vertical portion A1 with respect to necessary voltage levels of the (n+1)-th, (n+2)-th and (n−1)-th horizontal lines based on the variable voltage level. The first determining part 271 determines a first source voltage level of the n-th horizontal line in the first vertical portion A1 as a maximum value among the first minimum voltage levels and the first maximum voltage level received from the first detecting/converting part 251. A second determining part 272 calculates second minimum voltage levels of the n-th horizontal line in the second vertical portion A2 with respect to necessary voltage levels of the (n+1)-th, (n+2)-th and (n−1)-th horizontal lines based on the variable voltage level. The second determining part 272 determines a second source voltage level of the n-th horizontal line in the second vertical portion A2 as a maximum value among the second minimum voltage levels and the second maximum voltage level received from the second detecting/converting part 252. As described above, a k-th determining part 27*k* calculates second minimum voltage levels of the n-th horizontal line in the k-th vertical portion Ak with respect to necessary voltage levels of the (n+1)-th, (n+2)-th and (n−1)-th horizontal lines based on the variable voltage level. The k-th determining part 27*k* determines a k-th source voltage level of the n-th horizontal line in the k-th vertical portion A2 as a maximum value among the k-th minimum voltage levels and the k-th maximum voltage level received from the k-th detecting/converting part 25*k*.

The data correcting part 290 corrects data of the present horizontal line based on the source voltage level of the present horizontal line received from the source voltage determining part 270 to generate correction data of the present horizontal line. The data correcting part 290 provides the data driving part 130 with the correction data of the present horizontal line. The data correcting part 290 may correct the data of the present horizontal line utilizing a grayscale-voltage look-up table (LUT) and a lineal interpolation algorithm. According to the exemplary embodiment, the data correcting part 290 may include first to k-th correcting parts 291, 292, . . . , 29*k* respectively corresponding to the first to k-th vertical portions A1, A2, . . . , Ak.

A first correcting part 291 corrects the data of the present horizontal line in the first vertical portion A1 utilizing a first correction gamma curve which includes a maximum grayscale corresponding to the first maximum data and the first source voltage level corresponding to the maximum grayscale. For example, the first correcting part 291 corrects the data of the present horizontal line in the first vertical portion A1 utilizing a first grayscale-voltage LUT corresponding to the first correction gamma curve and outputs first correction data cDATA1 to the first data driving circuit 131. A second correcting part 292 corrects the data of the present horizontal line in the second vertical portion A2 utilizing a second correction gamma curve which includes a maximum grayscale corresponding to the second maximum data and the second source voltage level corresponding to the maximum grayscale. For example, the second correcting part 292 corrects the data of the present horizontal line in the second vertical portion A2 utilizing a second grayscale-voltage LUT corresponding to the second correction gamma curve and outputs second correction data cDATA2 to the second data driving circuit 132. As described above, a k-th correcting part 29*k* corrects the data of the present horizontal line in the k-th vertical portion Ak utilizing a k-th correction gamma curve which includes a maximum grayscale corresponding to the k-th maximum data and the k-th source voltage level corresponding to the maximum grayscale. For example, the k-th correcting part 29*k* corrects the data of the present horizontal line in the k-th vertical portion Ak utilizing a second grayscale-voltage LUT corresponding to the k-th correction gamma curve and outputs k-th correction data cDATAk2 to the k-th data driving circuit 13*k* (shown in FIG. 1).

The source voltage generating part 450 generates source voltages of the present horizontal line utilizing source voltage levels determined from the source voltage determining part 270 and provides the data driving part 130 with the source voltages. For example, the source voltage generating part 350 generates the first to k-th source voltages VDD1, VDD2, . . . , VDDk utilizing the first to k-th source voltage levels and provides the first to k-th data driving circuits 131, 132, . . . , 13*k* with the first to k-th source voltages VDD1, VDD2, . . . , VDDk, respectively.

Figure 3:
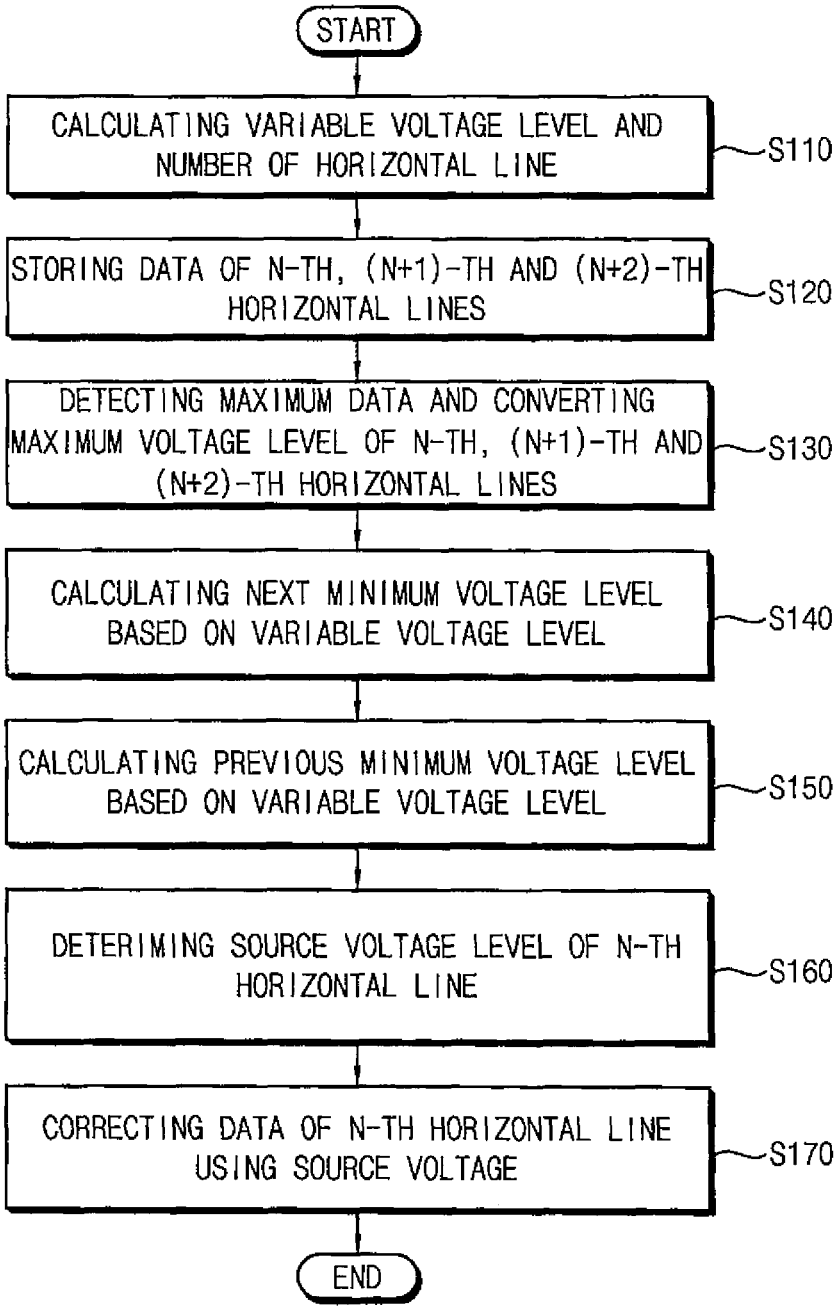
FIG. 3 is a flowchart view illustrating an operation of a data processing part as shown in FIG. 2.

FIG. 3 is a flowchart view illustrating an operation of a data processing part as shown in FIG. 2. FIG. 4 is a conceptual diagram illustrating a method of determining a level of a source voltage as shown in FIG. 3.

When an operation of the display apparatus starts, the calculating part 210 calculates a variable voltage level based on a change rate (slew rate) and a propagation delay time of the voltage outputted from the source voltage generating part 450. The voltage can change with the variable voltage level during a horizontal blanking period. In addition, the calculating part 210 calculates a number of the horizontal line corresponding to a period during which a reference voltage Vcom is arrived at a maximum source voltage VDDmax based on the variable voltage level (step S110). The reference voltage may have a voltage level corresponding to a black grayscale and the maximum source voltage may have a voltage level corresponding to a white grayscale. Hereinafter, the variable voltage level may be referred to as "4V", and the number of the horizontal line may be referred to as "3".

The data storing part 230 stores data of 3 horizontal lines based on the number of the horizontal line "3", for example, the data storing part 230 stores data of n-th, (n+1)-th and (n+2)-th horizontal lines LINE2, LINE3 and LINE4 (step S120).

The first to k-th detecting/converting parts 251, 252, . . . , 25*k* respectively detects maximum data in the first to k-th vertical portions A1, A2, . . . , Ak of the n-th horizontal line LINE2 and respectively converts the maximum data to a maximum voltage level. The first to k-th detecting/converting parts 251, 252, . . . , 25*k* respectively detects maximum data in the first to k-th vertical portions A1, A2, . . . , Ak of the (n+1)-th horizontal line LINE3 and respectively converts the maximum data to a maximum voltage level. The first to k-th detecting/converting parts 251, 252, . . . , 25*k* respectively detects maximum data in the first to k-th vertical portions A1, A2, . . . , Ak of the (n+2)-th horizontal line LINE4 and respectively converts the maximum data to a maximum voltage level (step S130). Hereinafter, a method of processing the data of the first to k-th vertical portions A1, A2, . . . , Ak may be referred to as a method of processing the data of the first vertical portion A1. The data of the horizontal line includes data of 0-grayscale to 255-grayscale. The voltage level corresponding to the 0-grayscale may be referred to as about "0V" and the voltage level corresponding to the 255-grayscale may be referred to as about "7.64 V".

The first detecting/converting part 251 respectively detects the maximum data of the n-th, (n+1)-th and (n+2)-th horizontal lines LINE2, LINE3 and LINE4 in the first vertical portion A1. Herein, the n-th horizontal line LINE2 is the present horizontal line, the (n+1)-th and (n+2)-th horizontal lines LINE3 and LINE4 are the next horizontal line and an (n−1)-th horizontal line LINE1 is the previous horizontal line. As shown in FIG. 4, the first detecting/converting part 251 detects the maximum data MAX_D of the n-th, (n+1)-th and (n+2)-th horizontal lines LINE2, LINE3 and LINE4. For example, the maximum data MAX_D of the n-th horizontal line LINE2 that is the present horizontal line is a 240-grayscale, the maximum data MAX_D of the (n+1)-th horizontal line LINE3 that is a first next horizontal line is a 215-grayscale and the maximum data MAX_D of the (n+2)-th horizontal line LINE4 that is a second next horizontal line is a 220-grayscale. The first detecting/converting part 251 converts the maximum data MAX_D to the maximum voltage level MAX_V. Thus, the 240-grayscale that is the maximum data MAX_D of the n-th horizontal line LINE2 is converted to about "6.53 V". The 215-grayscale that is the maximum data MAX_D of the (n+1)-th horizontal line LINE3 is converted to about "5.89 V". The 220-grayscale that is the maximum data MAX_D of the (n+2)-th horizontal line LINE4 is converted to about "5.98 V".

The source voltage determining part 270 calculates the minimum voltage level which includes (n+1)-th and (n+2)-th minimum voltage levels of the n-th horizontal line (LINE2) that is the present horizontal line based on the variable voltage level (step S140). The (n+1)-th minimum voltage level is to derive a voltage of the n-th horizontal line (LINE2) at a necessary voltage level of the (n+1)-th horizontal line (LINE3) based on the variable voltage level. The (n+2)-th minimum voltage level is to derive the voltage of the n-th horizontal line (LINE2) at a necessary voltage level of the (n+2)-th horizontal line (LINE4) based on the variable voltage level.

For example, the first determining part 271 calculates an (n+1)-th minimum voltage level MIN(n+1) which is to derive a voltage of the n-th horizontal line (LINE2) at the (n+1)-th maximum voltage level, that is the necessary voltage level of the (n+1)-th horizontal line (LINE3) based on the variable voltage level "4V". The (n+1)-th minimum voltage level MIN(n+1) may be defined as a level difference between the (n+1)-th maximum voltage level and the variable voltage level corresponding to a line space ("1") between the n-th horizontal line LINE2 and the (n+1)-th horizontal line LINE3. For example, MIN(n+1)=5.89 V−(4 V×1)≈1.89 V.

In addition, the first determining part 271 calculates an (n+2)-th minimum voltage level MIN(n+2) which is to derive a voltage of the n-th horizontal line (LINE2) at the (n+2)-th maximum voltage level, that is the necessary voltage level of the (n+2)-th horizontal line (LINE4) based on the variable voltage level "4V". The (n+2)-th minimum voltage level MIN(n+2) may be defined as a level difference between the (n+2)-th maximum voltage level and the variable voltage level corresponding to a line space ("2") between the n-th horizontal line LINE2 and the (n+2)-th horizontal line LINE4. For example, MIN(n+2)=5.98 V−(4 V×2)≈−2.02 V.

Then, the first determining part 271 calculates an (n−1)-th minimum voltage level MIN(n−1) which is to derive the necessary voltage level, that is a source voltage level AP_V of the (n−1)-th horizontal line (LINE1) to a voltage of the n-th horizontal line (LINE2), that is the present horizontal line based on the variable voltage level "4V" (step S150). The (n−1)-th minimum voltage level MIN(n−1) may be defined as a level difference between the source voltage level AP_V of the (n−1)-th horizontal line (LINE1) and the variable voltage level. For example, MIN(n−1)=5.78 V−4 V≈1.78 V.

Then, the first determining part 271 determines an n-th source voltage level AP_V of the n-th horizontal line LINE2 as a maximum value among the n maximum voltage level MAX_V, the (n+1)-th minimum voltage level MIN(n+1), the (n+2)-th minimum voltage level MIN(n+2) and the (n−1)-th minimum voltage level MIN(n−1) (step S160). As shown in FIG. 4, the source voltage level APV of the n-th horizontal line LINE2 is determined as "6.53 V". As described above, first to k-th source voltage levels of the n-th horizontal line, that is the present horizontal line may be determined concurrently (e.g., simultaneously).

The first to k-th correcting parts 291, 292, . . . , 29*k* correct the data of the n horizontal line, that is the present horizontal line utilizing the first to k-th source voltage levels of the n-th horizontal line (step S170).

Figure 5:
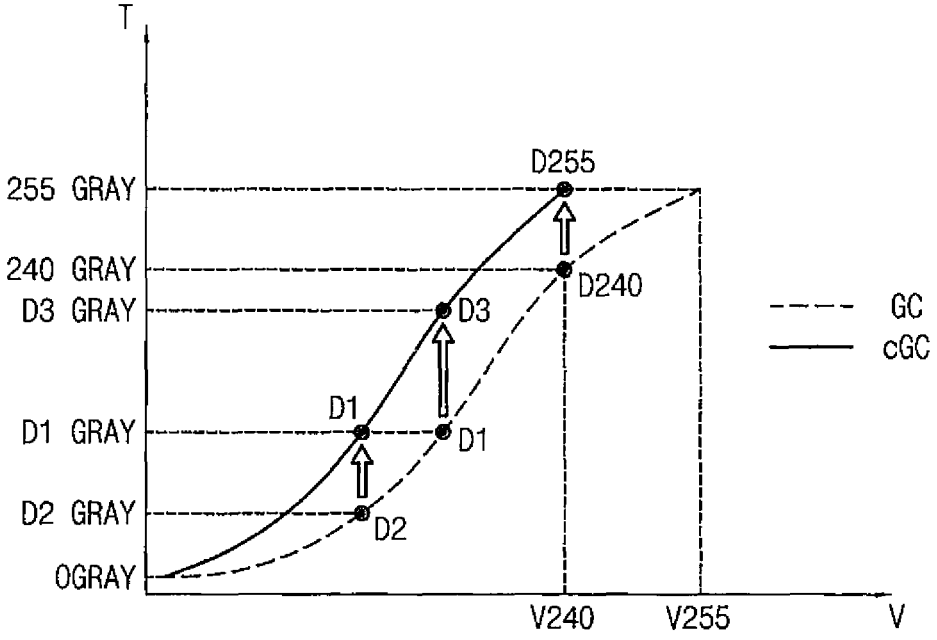
FIG. 5 is a conceptual diagram illustrating an operation of a data correction part as shown in FIG. 2.

FIG. 5 is a conceptual diagram illustrating an operation of a data correction part as shown in FIG. 2.

Referring to FIGS. 3, 4 and 5, the data correcting part 290 corrects the data of the n-th horizontal line, that is, the present horizontal line utilizing the first to k-th source voltage levels of the n-th horizontal line received from the source voltage determining part 270 to generate correction data of the n-th horizontal line.

For example, as shown in FIG. 4, a first correcting part 291 corrects data of the n-th horizontal line in the first vertical portion A1 utilizing a first correction gamma curve cGC. The first correction gamma curve cGC includes a maximum grayscale D255 which is the 240-grayscale D240 that is the maximum data MAX_D of the n-th horizontal line, and a maximum source voltage corresponding to the maximum grayscale D255 which is the source voltage level V240 of the n-th horizontal line received from the first determining part 271.

Generally, a gamma curve GC includes the maximum grayscale D255 and the maximum source voltage V255, however, the first correction gamma curve cGC includes the maximum grayscale corresponding to the 240-grayscale D240 and the maximum source voltage corresponding to the source voltage level V240.

The first correcting part 291 corrects data of grayscales lower than the 240-grayscale D240 utilizing the first correction gamma curve cGC. As shown in FIG. 5, data D2 of a D2-grayscale is corrected to data D of a D1-grayscale and data D1 of the D1-grayscale is corrected to data D3 of a D3-grayscale.

The first correcting part 291 may generate the correction data utilizing a first grayscale-voltage LUT corresponding to the first correction gamma curve cGC based on the source voltage level. In addition, in order to reduce a memory size, the grayscale-voltage LUT may store only correction data of a sampled grayscale, and correction data of remaining grayscale may be calculated by a lineal interpolation method.

As described above, the first to k-th correcting parts 291, 292, . . . , 29*k* generates the correction data of the present horizontal line utilizing first to k-th correction gamma curves corresponding to the first to k-th source voltage levels.

The first to k-th correcting parts 291, 292, . . . , 29*k* provide the first to k-th data driving circuits 131, 132, . . . , 13*k* with the correction data of the present horizontal line so that the display panel 110 may be driven by the vertical portion (e.g., the first vertical portion A1).

According to the exemplary embodiments of the present invention, the source voltage level applied to the data driving part may be adjusted by the vertical portion and the horizontal line based on the image displayed on the display panel. Thus, the display panel may be driven utilizing a minimum necessary voltage so that the power consumption may be reduced. In addition, the source voltage level of the present horizontal line may be determined based on the source voltage levels of at least one of the next horizontal line and the previous horizontal line so that a display quality may be improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, the method comprising:

determining a source voltage level by a vertical portion in a present horizontal line of the display panel based on data of the present horizontal line, the display panel including a plurality of vertical portions extended along a vertical direction and arranged in a horizontal direction, the plurality of vertical portions comprising the vertical portion;

generating correction data of the present horizontal line by the vertical portion utilizing the source voltage level of the present horizontal line determined by the vertical portion;

generating a source voltage of the present horizontal line by the vertical portion utilizing the source voltage level of a horizontal line determined by the vertical portion; and driving the display panel by the vertical portion utilizing the correction data and the source voltage of the present horizontal line, wherein the determining the source voltage level comprises:

calculating a variable voltage level with which a voltage can change during a horizontal blanking period;

calculating a number of the horizontal line corresponding to a period during which a reference voltage is to derive a maximum source voltage based on the variable voltage level;

converting maximum data of the present horizontal line and a next horizontal line which is located after the present horizontal line to maximum voltage levels, respectively;

calculating a next minimum voltage level of the present horizontal line, the next minimum voltage level which is to derive a voltage level of the present horizontal line in at a necessary voltage level of the next horizontal line;

calculating a previous minimum voltage level of the present horizontal line, the previous minimum voltage level which is to derive a necessary voltage level of a previous horizontal line at the voltage level of the present horizontal line, the previous horizontal line which is located before the present horizontal line; and determining the source voltage level of the present horizontal line utilizing the maximum voltage level, the next minimum voltage level and the previous minimum voltage level of the present horizontal line.

2. The method of claim 1, wherein the source voltage level of the present horizontal line is determined as a maximum value among the maximum voltage level, the next minimum voltage level and the previous minimum voltage level.

3. The method of claim 1, further comprising:

storing data of the horizontal line corresponding to the number of the horizontal line calculated based on the variable voltage level.

4. The method of claim 1, wherein the next minimum voltage level is calculated by utilizing the maximum voltage level of the next horizontal line and the variable voltage level.

5. The method of claim 1, wherein the previous minimum voltage level is calculated by utilizing the source voltage level of the previous horizontal line and the variable voltage level.

6. The method of claim 1, wherein the correction data of the present horizontal line is generated by utilizing a gray-voltage look-up table (LUT).

7. The method of claim 1, wherein the correction data and the source voltage of the present horizontal line are generated during the vertical blanking period.

8. A display apparatus comprising:

a display panel including a display element electrically connected to a data line and a gate line and is divided into a plurality of vertical portions comprising a vertical portion, the vertical portions extended along a longitudinal direction of the data line and arranged in a longitudinal direction of the gate line;

a data processing part configured to determine a source voltage level by the vertical portion in a present horizontal line of the display panel based on maximum data of the present horizontal line and to generate correction data of the present horizontal line by the vertical portion utilizing the source voltage level of the present horizontal line;

a source voltage generating part configured to generate a source voltage of the present horizontal line by the vertical portion utilizing the source voltage level of a horizontal line determined by the vertical portion; and a data driving part configured to drive the display panel by the vertical portion utilizing the correction data and the source voltage of the present horizontal line, wherein the data processing part is configured to determine the source voltage level of the present horizontal line by utilizing voltage levels of a previous horizontal line of the present horizontal line and a next horizontal line of the present horizontal line, and wherein the data processing part comprises:

a calculating part configured to calculate a variable voltage level with which a voltage can change during a horizontal blanking period and a number of the horizontal line corresponding to a period during which a reference voltage is to derive a maximum source voltage based on the variable voltage level;

a detecting/converting part configured to convert maximum data of the present horizontal line and the next horizontal line which is located after the present horizontal line to maximum voltage levels, respectively;

a source voltage determining part configured to calculate a next minimum voltage level of the present horizontal line, the next minimum voltage level which is to derive a voltage level of the present horizontal line in at a necessary voltage level of the next horizontal line, to calculate a previous minimum voltage level of the present horizontal line, the previous minimum voltage level which is to derive a necessary voltage level of the previous horizontal line at the voltage level of the present horizontal line, the previous horizontal line which is located before the present horizontal line and to determine the source voltage level of the present horizontal line utilizing the maximum voltage level, the next minimum voltage level and the previous minimum voltage level of the present horizontal line; and a data correcting part configured to generate the correction data of the present horizontal line by the vertical portion utilizing the source voltage level of the present horizontal line.

9. The display apparatus of claim 8, wherein the source voltage determining part configured to determine the source voltage level of the present horizontal line as a maximum level of the maximum voltage level, the next minimum voltage level and the previous minimum voltage level.

10. The display apparatus of claim 8, wherein the data processing part further comprises a storing part configured to store data of the horizontal line corresponding to the number of the horizontal line calculated based on the variable voltage level.

11. The display apparatus of claim 8, wherein the next minimum voltage level is calculated by utilizing the maximum voltage level of the next horizontal line and the variable voltage level.

12. The display apparatus of claim 8, wherein the previous minimum voltage level is calculated by utilizing the source voltage level of the previous horizontal line and the variable voltage level.

13. The display apparatus of claim 8, wherein the correction data of the present horizontal line is generated by utilizing a gray-voltage look-up table (LUT).

14. The display apparatus of claim 8, wherein the correction data and the source voltage of the present horizontal line are generated during the horizontal blanking period.

15. The display apparatus of claim 8, wherein the data driving part comprises first to k-th data driving circuits, and the plurality of vertical portions of the display panel are divided into first to k-th vertical portions corresponding to the first to k-th data driving circuits.

16. The display apparatus of claim 8, wherein the display element is a liquid crystal capacitor including a liquid crystal layer.

17. The display apparatus of claim 8, wherein the display element is an organic light emitting display OLED element including an organic light emitting layer.

18. The display apparatus of claim 8, wherein the display element is an electrophoretic display EPD element including an electrophoretic layer.

* * * * *